US010507489B2

(12) United States Patent
Satou et al.

(10) Patent No.: US 10,507,489 B2
(45) Date of Patent: Dec. 17, 2019

(54) METHOD MANUFACTURING FOR DECORATIVE CONSTRUCTION PLATE

(71) Applicant: NISSHIN STEEL CO., LTD., Tokyo (JP)

(72) Inventors: Masaki Satou, Tokyo (JP); Seiju Suzuki, Tokyo (JP); Masaru Hiraku, Tokyo (JP); Shuichi Sugita, Tokyo (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 7 days.

(21) Appl. No.: 15/575,460

(22) PCT Filed: Dec. 28, 2015

(86) PCT No.: PCT/JP2015/086520
§ 371 (c)(1),
(2) Date: Nov. 20, 2017

(87) PCT Pub. No.: WO2016/189770
PCT Pub. Date: Dec. 1, 2016

(65) Prior Publication Data

US 2018/0169695 A1 Jun. 21, 2018

(30) Foreign Application Priority Data

May 28, 2015 (JP) ..... 2015-108849

(51) Int. Cl.
*B05D 1/26* (2006.01)
*B05D 3/08* (2006.01)
(Continued)

(52) U.S. Cl.
CPC ..... *B05D 1/26* (2013.01); *B05D 3/08* (2013.01); *B05D 7/04* (2013.01); *B05D 7/24* (2013.01);
(Continued)

(58) Field of Classification Search
None
See application file for complete search history.

(56) References Cited

U.S. PATENT DOCUMENTS

2012/0003435 A1* 1/2012 Kameyama ..... C09D 11/101 428/195.1
2014/0102024 A1* 4/2014 Schiffmann ..... E04B 2/56 52/293.1

FOREIGN PATENT DOCUMENTS

JP 2000-107683 4/2000
JP 2008-036549 2/2008
(Continued)

OTHER PUBLICATIONS

Machine Translation of JP 5597296 B1 (Year: 2014).*

*Primary Examiner* — Shamim Ahmed
*Assistant Examiner* — Bradford M Gates
(74) *Attorney, Agent, or Firm* — Wenderoth, Lind & Ponack, L.L.P.

(57) ABSTRACT

The present invention provides a method for manufacturing a decorative construction plate, the method including subjecting a metal siding material including: a metallic substrate on which a recess-projection pattern having a height difference of 0.5 mm or more is formed and on which an ink receiving layer formed from a resin composition is provided; a core material; and a back-side material, to flame treatment by exposing the metal siding material to flame with an output of 250 kJ/h to 12000 kJ/h per 10-mm width of a flame port of a burner so that the surface temperature of the substrate does not exceed 300° C., followed by performing inkjet printing using an active ray curable ink.

6 Claims, 5 Drawing Sheets

(51) Int. Cl.

| | |
|---|---|
| ***B05D 7/24*** | (2006.01) |
| ***E04F 13/12*** | (2006.01) |
| ***B05D 7/04*** | (2006.01) |
| *E04F 13/08* | (2006.01) |

(52) U.S. Cl.
CPC ..... *E04F 13/12* (2013.01); *E04F 13/0873* (2013.01); *E04F 13/0875* (2013.01)

(56) References Cited

FOREIGN PATENT DOCUMENTS

| | | | | |
|---|---|---|---|---|
| JP | 2008-068453 | | 3/2008 | |
| JP | 2008-272953 | | 11/2008 | |
| JP | 2009-107298 | | 5/2009 | |
| JP | 4539104 | | 9/2010 | |
| JP | 5597296 | | 10/2014 | |
| JP | 5597296 | B1 * | 10/2014 | ..... B41M 5/0047 |

* cited by examiner

METHOD MANUFACTURING FOR DECORATIVE CONSTRUCTION PLATE

TECHNICAL FIELD

This invention relates to a method for manufacturing a decorative construction plate, the method including flame treatment under specific conditions prior to printing of patterns by inkjet printing on the surface of a metallic substrate of a metal siding material used in the field of construction materials.

BACKGROUND ART

In recent years, various patterns can be easily and inexpensively formed on substrates by inkjet printing, and thus inkjet printing is exploited in various fields.

For example, PTLs 1 and 2 respectively disclose a coated steel plate having a metallic substrate, an ink receiving layer containing polyester and an ink layer. When the coated steel plate is manufactured, the ink layer is formed by inkjet printing with a solvent-based ink on the surface of an ink receiving layer formed on the metal substrate. Some of the surface of the ink receiving layer is dissolved in an organic solvent contained in the solvent-based ink to form a rough surface, and thus the solvent-based ink can wet-spread on the ink receiving layer and adhere thereto.

PTLs 3 and 4 respectively disclose a coated steel plate used for a construction plate having a metallic substrate, an ink receiving layer obtained by applying and curing a wrinkle finish paint and an ink layer. When the coated steel plate is manufactured, the ink layer is formed by inkjet printing with a solvent-based or water-based ink on the surface of the ink receiving layer formed on the substrate. The ink can spread through grooves on the surface of the ink receiving layer by capillary action and thus sufficiently wet-spread on the surface.

With regard to inkjet printing, PTL 5 discloses an image forming method using an active ray curable ink, other than a solvent-based ink, that allows stable reproduction of highly defined images on various recording materials. PTL 6 discloses a method for manufacturing a decorative construction plate by inkjet printing using an active ray curable ink on a metallic siding material.

On the other hand, PTL 7 discloses a method for manufacturing a decorative construction plate such as an exterior material, in which, specifically, polar groups are introduced into the surface of a water-based enamel coating film formed on a substrate by frame treatment, thereby improving the wettability of a water-based inkjet ink and the aqueous coating film.

CITATION LIST

Patent Literature

[PTL1] Japanese Patent Application Publication No. 2000-107683

[PTL2] Japanese Patent Application Publication No. 2008-272953

[PTL 3] Japanese Patent Application Publication No. 2008-036549

[PTL 4] Japanese Patent Application Publication No. 2008-068453

[PTL 5] Japanese Patent No. 4539104

[PTL 6] Japanese Patent No. 5597296

[PTL 7] Japanese Patent Application Publication No. 2009-107298

SUMMARY OF INVENTION

Technical Problem

A metal siding material 1 of the present invention has, as illustrated in FIG. 1, a recess-projection pattern having a height difference d of 0.5 mm or more, and is formed with a metallic substrate 11, a core material 12 and a back-side material 13. An ink receiving layer 14 is further formed on the metallic substrate 11. On the metallic substrate 11, a chemical conversion treated film or primer coating film may be formed, on which the ink receiving layer 14 may be formed.

The ink receiving layer 14 is formed by applying and drying (or curing) a paint, which is a resin composition containing a resin and a pigment, on the metallic substrate. The metallic substrate is thereafter subjected to processing such as embossing or drawing for formation of tile-like, brick-like or woodgrain recesses and projections. In order to improve heat and sound insulating properties, a synthetic resin foam and the like is used as the core material 12 and the back-side of the metallic substrate is covered with the back-side material 13 such as an aluminum laminated kraft paper.

When the thus formed metal siding material 1 was subjected to inkjet printing using a solvent-based ink, the designability was satisfactory. However, when inkjet printing was performed using an active ray curable ink, the ink did not uniformly wet-spread, thereby resulting in insufficient designability of the printed image.

The inventors of the present invention conducted extensive studies on the above problem and, as a result, found that uniform wet-spreading of the active ray curable ink is prevented because of soil (foreign substances) adhered on the ink receiving layer 14 during manufacture of the metal siding material 1. The metallic substrate 11 of the metal siding material 1 is molded after being coated by the ink receiving layer 14, and covered on the back-side thereof with the core material 12 such as a synthetic resin foam. During the plurality of processing steps, the metal siding material 1 makes contact with manufacturing machines to which resins and additives derived from the ink receiving layer and the core material adhere, and the resins and additives then adhere to the ink receiving layer 14 of the following lot to cause soiling of the ink receiving layer 14.

In inkjet printing using a solvent-based ink, some of the surface of the ink receiving layer is dissolved in an organic solvent contained in the solvent-based ink to form a rough surface, and thus some soil on the ink receiving layer does not cause a significant effect. However, as an active ray curable ink is not permeable through the ink receiving layer, soil causes a significant reduction in wettability of ink. The fact that an ink receiving layer does not allow permeation of ink can be confirmed by microscopic observation of sections of an ink receiving layer and an ink layer at 100- to 200-fold magnification.

Solution to Problem

The inventors of the present invention attained uniform wet-spread of an active ray curable ink by subjecting the metal siding material 1 to flame treatment under specific conditions to burn and remove the soil adhered on the ink receiving layer 14.

Specifically, the present invention pertains to a method for manufacturing a decorative construction plate, the method including subjecting a metal siding material including: a metallic substrate on which a recess-projection pattern having a height difference of 0.5 mm or more is formed and on which an ink receiving layer formed from a resin composition is provided; a core material; and a back-side material, to flame treatment by exposing the metal siding material to flame with an output of 250 kJ/h to 12000 kJ/h per 10-mm width of a flame port of a burner so that the surface temperature of the substrate does not exceed 300° C., followed by performing inkjet printing using an active ray curable ink.

Advantageous Effects of Invention

According to the present invention, the metal siding material is subjected to flame treatment prior to inkjet printing to remove soil from the surface thereof, thereby allowing uniform wet-spread of an active ray curable ink and providing a decorative construction plate with high designability. In addition, by adjusting the conditions of flame treatment so that the temperature of the metallic substrate of the metal siding material during flame treatment is 300° C. or lower, detachment between the core material and the metallic substrate due to heat strain at the interface can be prevented.

DESCRIPTION OF EMBODIMENTS

Figure 1:
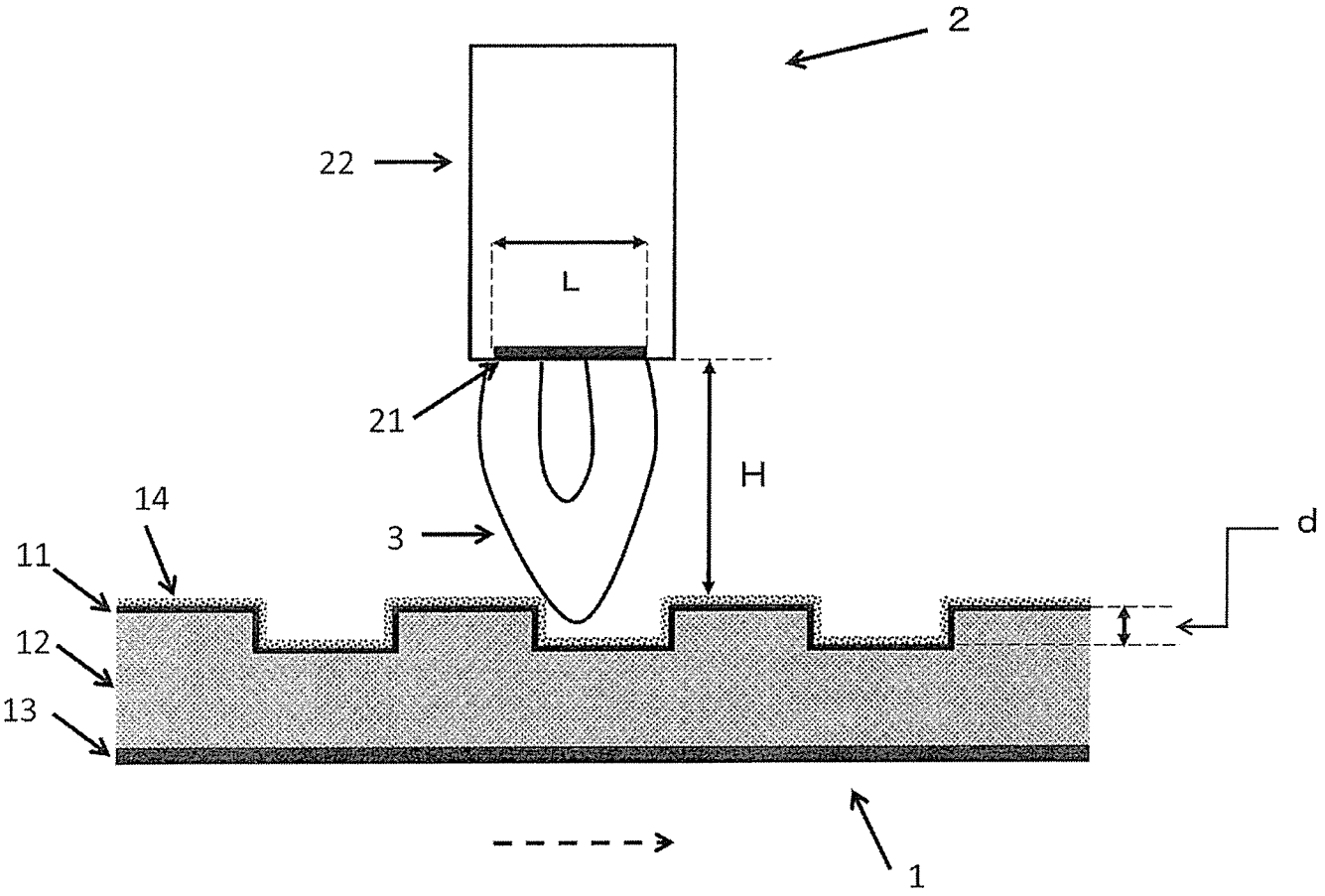
FIG. 1 shows an embodiment of flame treatment of a metal siding material 1 used in the present invention.

The decorative construction plate manufactured according to the present invention is obtained by subjecting the surface of the metal siding material 1 illustrated in FIG. 1 to flame treatment under specific conditions, followed by inkjet printing using an active ray curable ink.

Figure 2:
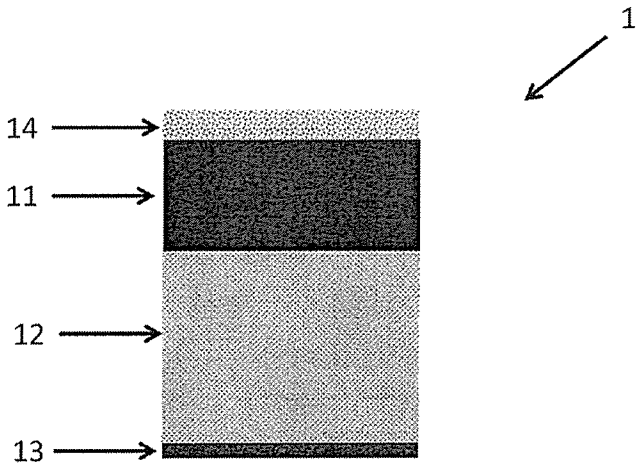
FIG. 2 shows a section of a metal siding material 1 used in the present invention.

As illustrated in FIG. 2, the metal siding material 1 includes a metallic substrate 11, a core material 12, a back-side material 13 and an ink receiving layer 14.

The metallic substrate 11 used may be a metal plate which is generally used for a metal siding material. Specific examples of the metal plate include plated steel plates such as molten Zn-55% Al alloy plated steel plates, steel plates such as common steel plates and stainless steel plates, aluminum plates and copper plates. The metal plate is subjected to processing such as embossing and drawing for formation of tile-like, brick-like or woodgrain recesses and projections.

The metallic substrate used for the present invention may have a chemical conversion treated film or a primer coating film on the surface thereof at an extent that does not suppress the effect of the present invention.

The metallic substrate 11 generally has a thickness of 0.15 to 0.5 mm without limitation.

As illustrated in FIG. 1, a recess-projection pattern having a height difference of 0.5 mm or more is formed on the metallic substrate 11 of the present invention. The term "recess-projection pattern having a height difference of 0.5 mm or more" as used herein means that at least one pair of a recess and a projection having a height difference d of 0.5 mm or more is formed on the metallic substrate 11, and that the pair of a recess and a projection forms a pattern. Therefore, a pair of a recess and a projection having a height difference of less than 0.5 mm may be present. By combining the recesses and projections, a pattern such as a tile-like pattern and a woodgrain pattern can be formed on the metallic substrate.

It is difficult to impart high designability to a pattern formed only of recesses and projections having a height difference d of less than 0.5 mm. With regard to the height difference d, the thickness of the ink receiving layer 14 should be taken into account. However, the thickness of the ink receiving layer 14 may be disregarded as the ink receiving layer 14 generally has a thickness in the range of 3 to 30 μm as described hereinbelow.

In order to form a pattern with further improved designability, it is preferable that recesses and projections having a height difference d of 1.0 mm or more and more preferably 1.5 mm or more are formed on the metal siding material 1.

The upper limit of the height difference between recesses and projections of the metallic substrate is not particularly limited as far as the effect of the present invention is exhibited. The height difference d between recesses and projections on the metallic substrate is generally 7 mm or less and preferably 5 mm or less. When the height difference between recesses and projections on the metallic substrate is 7 mm at maximum, a pattern with sufficient designability for a metal siding material may be formed. When the height difference between recesses and projections on the metallic substrate is above 7 mm, foreign matter at the bottom of recesses may not be exposed to flame, making it difficult to remove the foreign matter.

Meanwhile, even when the height difference d between recesses and projections is 1.5 mm at maximum, a pattern may be formed. Therefore, the height difference d may be 1.5 mm or less.

The core material 12 is formed from a synthetic resin foam. Examples of the synthetic resin foam include polyurethane foam, polyisocyanurate foam, phenol resin foam, vinyl chloride resin foam, a polyethylene foam, polystyrene foam, urea resin foam and the like. The core material 12 may alternatively be formed from an inorganic material such as rock wool, glass wool and ceramic wool.

The back-side material 13 may be formed from a sheet-like material obtained by laminating one or more selected from aluminum deposited paper, kraft paper, asphalt felt, metal foils (foils of Al, Fe, Pb, Cu, etc.), synthetic resin sheets, rubber sheets, fabric sheets, gypsum paper, aluminum hydroxide paper, glass fiber fabrics, glass fiber nonwoven fabrics and the like, or providing the foregoing sheet-like material with waterproof treatment or treatment to impart retardancy.

The metal siding material has fitting members for mutual connection. The fitting members are generally generated by folding both ends in the width direction of the metallic substrate so as to form male and female structures.

The ink receiving layer 14 used for the present invention may be a coating film formed by curing a resin composition. In the present invention, a resin of a polymer compound that is generally used as a paint capable of forming a coating film on the above substrate may be used. Examples include polyester resin, acryl resin, polyvinylidene fluoride resin, polyurethane resin, epoxy resin, polyvinyl alcohol resin, phenol resin and the like. Among others, the polymer compound used for the present invention is preferably a polyester resin or an acryl resin because of high weather resistance and excellent adhesion with ink.

It is preferable that a paint is not used that forms a porous ink receiving layer such as those generally used as an ink receiving layer for a water-based ink. Such a porous ink receiving layer may have low water resistance and weather resistance and thus may not be suitable for construction material application.

The resin of the polymer compound described above may contain a curing agent in order to adjust the characteristics and physical properties of the resin. When a polyester resin is used, it is preferable to use a melamine-based curing agent (melamine resin curing agent). Examples thereof include methylated melamine (methylol melamine methyl ether), n-butylated melamine (methylol melamine butyl ether) and mixed etherified melamine of methyl and n-butyl. The ink receiving layer having an increased crosslink density by using the curing agent is particularly preferable because a non-water-based ink does not permeate, resulting in excellent water resistance and weather resistance. The fact that the ink receiving layer does not allow permeation of an active ray curable ink may be confirmed by microscopic observation of sections of an ink receiving layer and an ink layer at 100- to 200-fold magnification. When the ink receiving layer is impermeable, the interface between the ink receiving layer and the ink layer can be clearly observed, while when the ink receiving layer is permeable, the interface is indefinite and is difficult to be recognized.

When the polymer compound is a polyester resin, it is preferable that the polyester resin has a molecular weight such that the number average molecular weight measured by GPC is 2,000 to 8,000. When the molecular weight is less than 2,000, processability may be decreased and cracks may tend to be generated in the coating film. When the molecular weight is above 8,000, the crosslink density may be decreased, resulting in decreased weather resistance. In view of the balanced processability and weather resistance, the number average molecular weight is preferably 3,000 to 6,000.

The ink receiving layer 14 of the present invention may contain organic or inorganic solid particles. The particles have an average particle diameter of 4 to 80 μm, preferably 10 to 60 μm.

Examples of the inorganic particles include silica, barium sulfate, talc, calcium carbonate, mica, glass beads and glass flakes. Examples of the organic particles include acryl resin beads and polyacrylonitrile resin beads. The resin beads may be produced according to well-known methods or may be commercially available. Examples of commercially available acryl resin beads include "TAFTIC AR650S (average particle diameter: 18 μm)", "TAFTIC AR650M (average particle diameter: 30 μm)", "TAFTIC AR650MX (average particle diameter: 40 μm)", "TAFTIC AR650MZ (average particle diameter: 60 μm)", "TAFTIC AR650ML (average particle diameter: 80 μm)", "TAFTIC AR650L (average particle diameter: 100 μm)" and "TAFTIC AR650LL (average particle diameter: 150 μm)" from Toyobo Co., Ltd. Examples of commercially available polyacrylonitrile beads include "TAFTIC A-20 (average particle diameter: 24 μm)", "TAFTIC YK-30 (average particle diameter: 33 μm)", "TAFTIC YK-50 (average particle diameter 50 μm)" and "TAFTIC YK-80 (average particle diameter 80 μm)" from Toyobo Co., Ltd.

The content of organic or inorganic particles is generally 2% to 40% by mass, preferably 10% to 30% by mass of the mass of the coating film.

The average particle diameter of the solid particles and coloring pigment may be determined according to the Coulter counter method.

The ink receiving layer 14 may further contain a coloring pigment. The coloring pigment, in this case, has an average particle diameter of 0.2 to 2.0 μm in general. Examples of the coloring pigment include titanium oxide, iron oxide, yellow oxide of iron, phthalocyanine blue, carbon black, cobalt blue and the like. When the coloring pigment is used, the coloring pigment is added to the paint so that the coloring pigment accounts for 40% to 60% by mass of the mass of the coating film.

The ink receiving layer 14 generally has, but is not particularly limited to, a film thickness in the range of 3 to 30 μm. When the coating film is too thin, the coating film may have insufficient durability and obscuring property. When the coating film is too thick, on the other hand, the production cost may increase and foaming may tend to occur during baking.

The active ray curable ink of the present invention is an ink that is generally used in the art, and includes radically polymerizable ink and cationically polymerizable ink both of which may be used.

The active ray curable ink generally contains a monomer or oligomer, a photopolymerization initiator, a color material, a dispersing agent, a surfactant and an additive other than the foregoing. In the present invention, materials that are generally used in the art are used. The cationically polymerizable ink has less volume shrinkage compared to the radically polymerizable ink and has high adhesion to an impermeable ink receiving layer having an increased crosslink density, and thus is particularly preferable.

Figure 3:
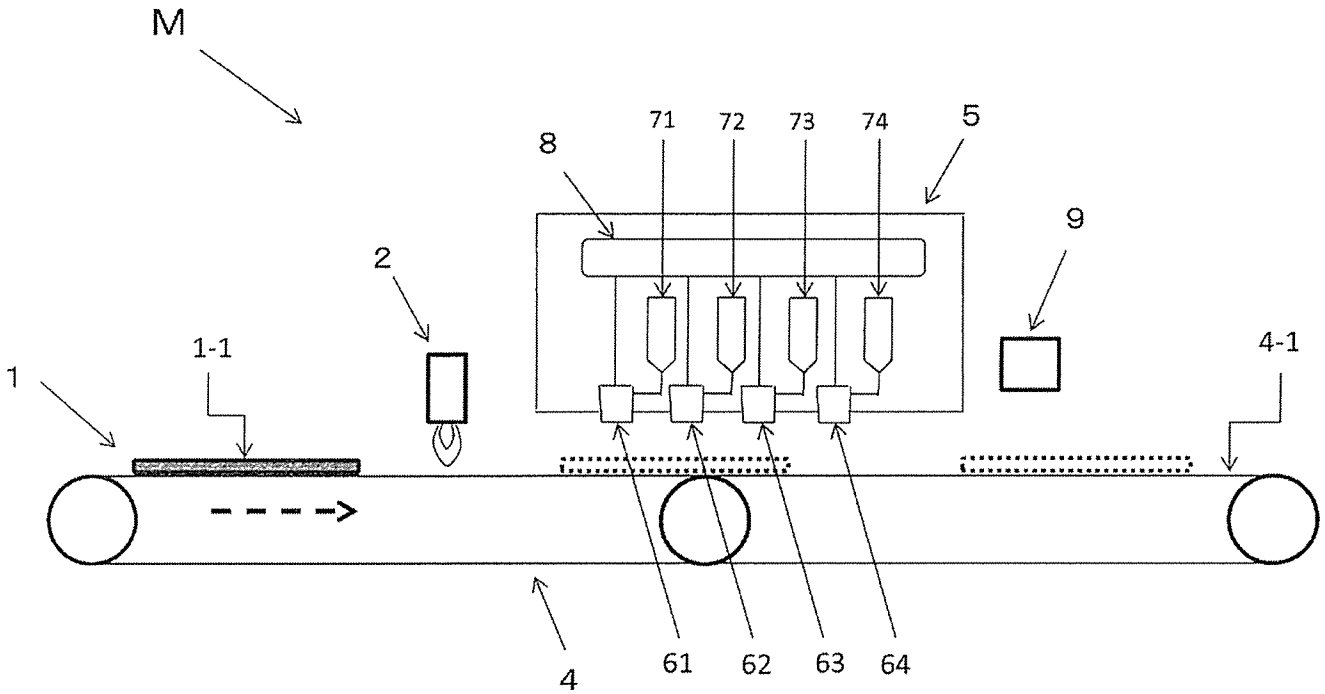
FIG. 3 shows an example of a line inkjet recording device used for performing the present invention.

An embodiment of the present invention is illustrated by referring to FIG. 3. In the present embodiment, the metal siding material 1 is subjected to flame treatment using a burner 2. The inkjet recording device used is a line inkjet recording device M capable of inkjet printing with four color inks (yellow, cyan, magenta and black). The inks used are active ray curable inks.

The line inkjet recording device M in FIG. 3 includes an inkjet coating machine 5 which includes an inkjet recording head 6 (61 to 64), an ink supply tank 7 (71 to 74) connected to the recording head and a control unit 8, and a transporting machine 4. The line inkjet recording device M is further equipped with a burner 2 for performing flame treatment and an active ray irradiation machine 9. The metal siding material 1 is transported along the direction of the dashed arrow in FIG. 3.

A printing surface (ink receiving surface) 1-1 of the metal siding material 1 is on the side opposite to the surface which is in contact with a transporting surface 4-1 of the transporting machine 4. The printing surface is colored with active ray curable inks ejected from the inkjet recording heads and a desired image may be formed on the ink receiving layer 14.

As illustrated in FIG. 3, the printing surface 1-1 of the metal siding material 1 is subjected to flame treatment with flame ejected from the burner 2 before inkjet printing.

A specific embodiment of the flame treatment is illustrated in FIG. 1. The burner 2 includes a burner head 22 and a flame port 21 from which flame is ejected. The length L of the flame port 21 is adjustable in the direction parallel to the transportation direction (dashed arrow) in FIG. 1. L is generally 3 to 40 mm. When the transportation velocity of the metal siding material 1 is high, a gas flow is generated in accordance with the movement of the metal siding material 1. When the value of L is small, a flame 3 of the burner is easily affected by the gas flow, and the flame 3 may not be uniformly irradiated. Therefore, it is preferable to adjust L and the transportation velocity by taking optimal conditions into account.

The burner 2 is disposed at a distance H from the printing surface 1-1 of the metal siding material 1. H means the shortest distance between the burner 2 and the printing surface 1-1. Namely, H generally represents the distance between the burner head 22 and the printing surface 1-1. However, when the flame port 21 is projected from the burner head 22 and thus the distance between the flame port 21 and the printing surface 1-1 is shorter than the distance between the burner head 22 and the printing surface 1-1, H represents the distance between the flame port 21 and the printing surface 1-1.

The distance H is set to be in the range of generally 10 to 120 mm, preferably 25 to 100 mm, more preferably 30 to 90 mm and the most preferably 40 to 80 mm. The metallic substrate 11 of the metal siding material 1 undergoes molding processing such as embossing or drawing. Therefore, the metallic substrate 11 may be warped. When the distance H is less than 10 mm, the burner 2 may be in contact with the metal siding material 1 due to the warped metallic substrate. As the metal siding material 1 is used as a construction plate, the metallic substrate 11 may be a few meters (3 to 4 m) in length in some cases and in such cases, the warp generated on the metallic substrate 11 may be 10 to 20 mm. Therefore, it is required that the distance H is adjusted according to the length of the metallic substrate 11, namely the length of the metal siding material 1.

When the distance H is above 120 mm, high energy flames may need to be irradiated in order to attain the effect of the flame treatment, which is inefficient and is not preferable, and even when the output of the burner is 12000 kJ/h per 10-mm width of the flame port of the burner, foreign substances may not be sufficiently removed.

The output of the burner is preferably 250 kJ/h to 12000 kJ/h, preferably 400 kJ/h to 7500 kJ/h, more preferably 600 kJ/h to 5000 kJ/h and still more preferably 1200 kJ/h to 5000 kJ/h per 10-mm width of the flame port of the burner. When the output is less than 250 kJ/h per 10-mm width of the flame port of the burner, the flame is too weak to sufficiently burn and remove soil (foreign substances) on the surface of the metal siding material 1. As a result, the active ray curable ink does not uniformly wet-spread on the ink receiving layer. When the output exceeds 12000 kJ/h per 10-mm width of the flame port of the burner, the surface temperature of the metallic substrate 11 exceeds 300° C. in a short time, and the interface between the core material 12 and the metallic substrate 11 is heat-strained, resulting in detachment of the core material 12 from the metallic substrate 11. In addition, by taking the heat storage performance of the metallic substrate 11 into account, the surface temperature of the metallic substrate 11 is preferably 250° C. or less.

The surface temperature of the metallic substrate 11 is measured at an arbitrary location on the printing surface of the metal siding material 1 with a thermocouple thermometer (K-type) of which the thermocouple head is welded to the ink receiving layer 14 of the metal siding material 1 where a part of the ink receiving layer 14 is removed by filing or the like.

Figure 4:
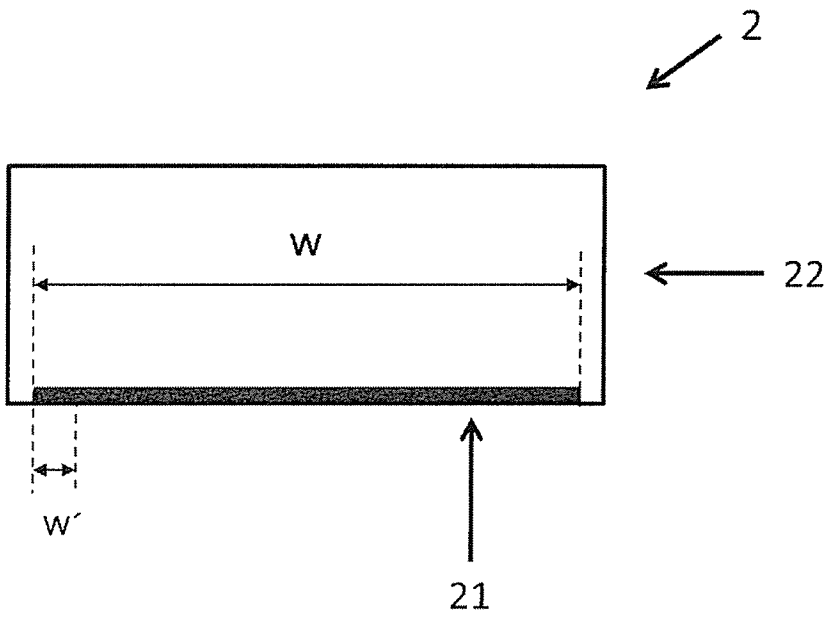
FIG. 4 is a front schematic view of a burner head of a burner used for performing the present invention.

FIG. 4 is a front view of the burner 2 in FIG. 1 or FIG. 3. W represents the width of the flame port 21 of the burner 2. W is selected by taking the width of the metal siding material 1 into account and is generally 40 to 50 cm. The form of the flame port is not particularly limited, and a burner having a ribbon-shaped or circular hole-shaped flame port may generally be used.

A burner having a burner head with such a structure is commercially available which includes, for example, product name F-3000 from Flynn Burner Corporation (U.S.), product name FFP250 from Finecom I&T (Korea) and the like.

The above phrase "per 10-mm width of the flame port of the burner" means that W in FIG. 4 is 10 mm.

The transportation velocity of the metal siding material 1 by the transporting machine 4 is not particularly limited as far as the effect of the present invention is exhibited, and is generally 5 to 70 m/min relative to the fixed burner 2. The velocity is preferably 10 to 40 m/min and still more preferably 15 to 30 m/min. When the transportation velocity is less than 5 m/min, the surface temperature of the metallic substrate 11 may exceed 300° C. even when the output of the burner is decreased. When the velocity is above 70 m/min, the flame of the burner 2 is affected by the gas flow generated by the movement of the metal siding material 1, the printing surface 1-1 of the metal siding material 1 may not be uniformly exposed to the flame, and thus soil (foreign substances) may not be sufficiently removed.

Fuel gas of the burner 2 is not particularly limited and generally is hydrogen, liquefied petroleum gas (LPG), liquefied natural gas (LNG), acetylene gas, propane gas, butane and the like, and supporting gas thereof is air or oxygen. When taking energy on combustion into account, it is preferable to use LPG and LNG.

The flame-treated metal siding material 1 is subjected to inkjet printing on the inkjet coating machine 5. Four color inks are used, and yellow, cyan, magenta and black are ejected from the inkjet recording heads 61, 62, 63 and 64, respectively. The inkjet recording heads are respectively connected to the ink supply tanks (71 to 74). The inks may be commercially available active ray curable inks.

Ink droplets ejected from the inkjet recording heads of the respective colors fly towards the printing surface 1-1 in the vertical direction. The initial velocity of the ink droplets is set to be generally 3 m/sec to 9 m/sec, preferably 4 m/sec to 7 m/sec. The initial velocity of the ink droplets means the velocity of the ink droplets at the time of ejection from the recording head. For example, the initial velocity is calculated from the distance (1 mm) through which the ink droplets ejected from the inkjet recording head travel from the ink ejection part in the vertical direction and the time required to move the distance of 1 mm (predetermined distance/time).

When the initial velocity of the ink droplets is less than 3 m/sec which is too low, landing accuracy of the ink droplets may be significantly decreased. When the initial velocity is above 9 m/sec, despite good landing accuracy, ink satellites may be generated, reducing the image quality.

The volume of one ink droplet ejected from the nozzle of the inkjet recording head towards the printing surface 1-1 is not particularly limited, and is generally set to be less than 60 pl (picoliters), preferably 10 pl or more and less than 45 pl.

The active ray irradiation machine 9 is disposed at a predetermined position downstream of the inkjet coating machine 5 in the transportation direction. The term "active ray" as used herein includes electron beams, ultraviolet rays, a rays, y rays, X rays and the like. In the present invention, it is preferable to use electron beams or ultraviolet rays and it is most preferable to use ultraviolet rays when safety and ease of handling are taken into account.

The active ray irradiation machine 9 includes a lamp for active ray irradiation that is disposed towards the transporting surface 4-1 of the transporting machine 4 and irradiates active rays towards the transporting surface 4-1.

Ink droplets landing onto the printing surface 1-1 are cured with active rays from the active ray irradiation machine 9. The transportation velocity of the transporting machine 4 and the distance from the inkjet coating machine to the active ray irradiation machine 9 are adjusted so that active rays are irradiated at generally 1.0 second or more, preferably 2.0 seconds or more and still more preferably 2.2 seconds or more after the ink droplets have landed. Moisture in air may inhibit polymerization of ink, and thus active rays are irradiated within 30 seconds after the ink is landed.

The control unit 8 controls various processes such as patterning by recorded images formed by the inkjet recording device M and temperature control of the inkjet recording head. The control unit 8 includes, for example, electric wirings and a circuit board onto which electronic components are mounted. At least some configurations in the control unit 8 are, as shown in FIG. 3, disposed above the inkjet recording heads.

The line inkjet recording device M includes a predetermined interface (not shown) such as a network interface. The inkjet recording device M is communicatively connected with an external device such as a personal computer via the interface. The external device inputs, to the inkjet recording device M, an order for recording an image onto the printing surface 1-1, and data representing the image to be recorded, for example. The inkjet recording device M which receives an order for recording performs a predetermined process, the inks are ejected from the inkjet recording heads, a desired image is formed on the printing surface 1-1, and thus the method for manufacturing a decorative construction plate of the present invention is carried out.

Examples

The present invention is hereinafter more specifically described by way of Examples and Test Examples which do not limit the present invention.

1. Preparation of Metal Siding Material (1-1) Preparation of Metallic Substrate

The substrate used was a molten Zn-55% Al alloy plated steel plate having a plate thickness of 0.27 mm and a coating weight per side with A4 size of 90 g/m$^2$. The plated steel plate was subjected to alkaline degreasing. Thereafter, application-type chromate (NRC300NS: produced by Nippon Paint Co., Ltd., coating weight as Cr of 50 mg/m$^2$) and a commercially available epoxy resin primer paint (produced by Nippon Fine Coatings, Inc., 700P) as a primer layer were applied with a roll coater so as to attain a dry film thickness of 5 μm. Baking was carried out so as to attain a maximum plate temperature of 215° C.

(1-2) Preparation of Ink Receiving Layer

The composition of the paint which is a resin composition for forming an ink receiving layer is as follows. The resin used was a polyester resin (produced by DIC Corporation) having a number average molecular weight of 5,000, a glass transition temperature of 30° C. and a hydroxyl value of 28 mgKOH/g. The crosslinking agent used, which is a melamine resin, was a methylated melamine resin (produced by Mitsui Cytec Ltd., Cymel 303) having 90% by mole of methoxy groups. The ratio between the polyester resin and the melamine resin was 70/30. The coloring pigments added were 49% by mass of titanium oxide (produced by Tayca Corporation, JR-603) having an average particle diameter of 0.28 μm, 13% by mass of mica (produced by Yamaguchi Mica Co., Ltd., SJ-010) having an average particle diameter of 10 μm, 6% by mass of hydrophobic silica (Sylysia 456, Fuji Silysia Chemical Ltd.) having an average particle diameter of 5.5 μm and 2% by mass of hydrophobic silica (produced by Fuji Silysia Chemical Ltd., Sylysia 476) having an average particle diameter 12 μm. As a catalyst, dodecylbenzenesulfonic acid was added at 1% by mass relative to the solid resin content. As an amine, dimethylaminoethanol was added in an amine equivalent 1.25 times of the acid equivalent of dodecylbenzenesulfonic acid. Coating was performed with a roll coater so as to attain a dry film thickness of the paint of 18 μm followed by baking so as to attain a maximum plate temperature of 225° C.

The average particle diameter of mica, hydrophobic silica and titanium oxide above was determined by the Coulter counter method.

Specifically, determination was carried out as follows. The analytical device used was a Coulter counter (produced by Coulter Electronics Ltd., U.S.A.) type TA-II. About 0.5 g of a sample was placed in a 200-ml beaker to which about 150 ml of pure water was added and the sample was dispersed by ultrasound (ULTRASONIC CLEANER B-220) for 60 to 90 seconds. A few drops of the dispersion were added to 150 ml of electrolytic solution (ISOTON II: 0.7% highly pure NaCl aqueous solution) provided and the particle size distribution was determined on the device.

For JR-603 (titanium oxide) and Sylysia 456 (hydrophobic silica), an aperture tube of 30 μm was used. For SJ-010 (mica), an aperture tube of 50 μm was used. The average particle diameter was determined by reading the 50% diameter in the cumulative particle size distribution.

(1-3) Formation of Recesses and Projections on Metallic Substrate

The metallic substrate having the ink receiving layer above was subjected to surface treatment by embossing.

The metallic substrate having the ink receiving layer on an uncoiler was continuously fed while continuously embossing the metallic substrate into a brick pattern with a height of 0.5 to 1.5 mm on a roll embossing molding machine, thereby forming the metallic substrate provided with a granite pattern.

(1-4) Formation of Core Material and Back-Side Material

On the backside of the formed metallic substrate, polyisocyanurate starting materials which serve as the core material, namely Soflan R-HIP and Toyo Soflan R746-19D (both produced by SoflanWiz Co., Ltd.) were ejected from a mixing extruder while mixing at a mass ratio of 10 to 7 in a foaming machine. On the layer of the polyisocyanurate starting materials to be foamed, an aluminum kraft paper (back-side material) was fed. The embossed metallic substrate and the aluminum kraft paper with the layer of the polyisocyanurate starting materials sandwiched therebetween were heated, pressed and foamed to produce the metal siding material including the metallic substrate having the ink receiving layer, the core material and the aluminum kraft paper in this order. The core material was configured to have a thickness of 17 mm. The thickness of the core material was adjusted by adjusting the distance between double conveyors which sandwich the metal siding original plate during heating and pressing in the lamination direction of the plate.

Specific foaming conditions of the polyisocyanurate starting materials are as follows.

Line speed: 40 m/min

Flow rate: 6 kg/min

Liquid temperature: 30° C.

Pre-heating temperature of the metallic substrate having the ink receiving layer: 35° C.

Oven cure temperature: 50° C.

Foaming machine: low-pressure agitator mixing foaming machine

2. Burner for Flame Treatment

The burner for flame treatment used was FFP200 (produced by Finecom I&T (Korea)). The combustion gas used was LP gas. Flame treatment was carried out by mixing 0.04 to 2.00 L/min of LP gas and 1 to 50 L/min of clean dry air per 10-mm width of the flame port of the burner in a gas mixer and then combusting the mixed gas on the burner. The burners used had a length (L in FIG. 1) of the flame port parallel to the transportation direction of 5 mm, 20 mm, 30 mm and 40 mm, respectively.

The transportation velocity during flame treatment was 5 to 70 m/min.

3. Inkjet Printing Using Active Ray Curable Inks (3-1)

The active ray curable inks used were a radically polymerizable ultraviolet curable black ink and a cationically polymerizable ultraviolet curable black ink. Specific compositions of the inks are as follows.

(i) Radically Polymerizable Ultraviolet Curable Black Ink

The radically polymerizable ultraviolet curable black ink was prepared by mixing the following components. The specific composition thereof is as follows.

Pigment dispersion[1)] (pigment content: 10% by mass) 10 parts by mass

Reactive oligomer[2)] 25 parts by mass

Reactive oligomer[3)] 57 parts by mass

Photopolymerization initiator[4)] 5 parts by mass

Photopolymerization initiator[5)] 3 parts by mass

1) Pigment: NIPex 35, produced by Carbon Degussa Japan K.K., dispersing medium: SR9003, PO-modified neopentyl glycol diacrylate, produced by Sartomer Japan Inc.

2) CN985B88, a mixture of 88% by mass of bifunctional aliphatic urethane acrylate and 12% by mass of 1,6-hexanediol diacrylate, produced by Sartomer Japan Inc.

3) 1,6-Hexanediol diacrylate

4) IRGACURE 184, a hydroxy ketone, produced by Ciba Japan K.K.

5) IRGACURE 819, an acyl phosphine oxide, produced by Ciba Japan K.K.

(ii) Cationically Polymerizable Ultraviolet Curable Ink

To 9 parts by mass of a polymer dispersing agent (produced by Ajinomoto Fine-Techno Co., Inc., PB821) and 71 parts by mass of an oxetane compound (produced by Toagosei Co., Ltd., OXT211), 20 parts by mass of black: Pigment Black 7 was added and was placed in a glass bottle with 200 g of zirconia beads having a diameter of 1 mm and the glass bottle was sealed. The glass bottle was subjected to dispersion treatment for 4 hours on a paint shaker followed by removal of zirconia beads to prepare a black pigment dispersion.

The dispersion (14 parts by mass) was mixed with the following photopolymerizable compound, basic compound, surfactant, compatibilizing agent and photoacid generating agent to prepare a cationically polymerizable ultraviolet curable inkjet ink.

TABLE 1

| Components | Amount |
|---|---|
| Photopolymerizable compounds | |
| Epoxidized linseed oil Vikoflex 9040 (produced by ATOFINA) | 4 parts by mass |
| EP-1, for the structural formula, see Japanese Patent No. 4539104 | 34 parts by mass |
| Oxetane compound OXT-221 (produced by Toagosei Co., Ltd.) | 24 parts by mass |
| Oxetane compound OXT-211 (produced by Toagosei Co., Ltd.) | 8.9 parts by mass |
| Basic compound | |
| N-ethyldiethanolamine | 0.05 parts by mass |
| Surfactants | |
| Megafac F178k (perfluoroalkyl group-containing acryl oligomer (produced by DIC Corporation)) | 0.025 parts by mass |
| Megafac F1405 (perfluoroalkyl group-containing ethylene oxide adduct (produced by DIC Corporation)) | 0.025 parts by mass |
| Compatibilizing agent | |
| Hisolv BDB (produced by Toho Chemical Industry Co., Ltd., glycol ether) | 10 parts by mass |
| Photoacid generating agent | |
| UV16992 (produced by The Dow Chemical Company) | 5 parts by mass |

Dot printing was performed using black ink by an inkjet printer (produced by Tritek Co., Ltd., PatterningJET) with the volume of the ink droplet of 42 pl. The printing conditions were as follows. Dot printing using black ink was performed throughout the metal siding material with the distance between dots of 500 μm so that dots did not overlap. The dot diameter was measured with a scanning confocal laser microscope LEXT OLS3000 produced by Olympus Corporation. By magnifying to the field in which only one dot could be observed (200-fold), dot diameters of eight dots were measured and the results were averaged. When a dot was close to an ellipse, the average of the long diameter and the short diameter was regarded as the dot diameter. On the metallic siding before flame treatment, the dot diameters varied depending on the extent of soil adhesion. Namely, the dot diameter on the area where soil was highly adhered was about 130 μm while that on the area where almost no soil was adhered was about 180 μm, resulting in a difference of about 50 μm.

Inkjet printing conditions of the radically polymerizable ultraviolet curable ink (a) Nozzle diameter: 35 μm (b) Applied voltage: 11.5 V (c) Pulse width: 10.0 μs (d) Drive frequency: 3,483 Hz (e) Resolution: 360 dpi (f) Volume of ink droplets: 42 pl (g) Head heating temperature: 45° C.

(h) Ink coating weight: 8.4 g/m$^2$ (i) Distance between head and recording surface: 5.0 mm (j) Initial velocity of ink droplets: 5.9 m/sec Inkjet printing conditions of the cationically polymerizable ultraviolet curable ink (a) Nozzle diameter: 35 μm (b) Applied voltage: 13.2 V (c) Pulse width: 10.0 μs (d) Drive frequency: 3,483 Hz (e) Resolution: 360 dpi (f) Volume of ink droplets: 42 pl
(g) Head heating temperature: 45° C.
(h) Ink coating weight: 8.4 g/$m^2$
(i) Distance between head and recording surface: 5.0 mm
(j) Initial velocity of ink droplets: 6.1 m/sec In the present Example, the active rays used were ultraviolet rays. Ink was cured with ultraviolet light after inkjet printing under the following conditions. Ultraviolet irradiation was performed at 5 seconds after landing of ink droplets.

(1) Lamp Type: high-pressure mercury lamp (produced by Fusion UV Systems Japan K.K., H valve)
(2) Output of the lamp: 200 W/cm
(3) Integrated amount of light: 600 mJ/$cm^2$ (measured on a UV meter UV-351-25 produced by Orc Manufacturing Co., Ltd.)

Despite the amount of soil adhesion on the surface of the metal siding material, flame treatment under specific conditions allows uniform and sufficient wet-spread of ink. In the present Example, the dot diameter of the radically polymerizable ultraviolet curable ink which was 190 to 210 μm after flame treatment was rated as O. The dot diameter of the cationically polymerizable ultraviolet curable ink which was 200 to 220 μm was rated as O.

4. Measurement of Metallic Substrate Temperature

A thermocouple thermometer (K-type) (Hioki E. E. Corporation, temperature logger LR5021) and a sensor (Anritsu Meter Co., Ltd., tape-type multipurpose temperature sensor) were attached to the surface of the metallic substrate of the metal siding material for measurement.

5. Method for Measuring the Bonding Strength Between Metallic Substrate and Core Material (Synthetic Resin Foam)

Figure 5:
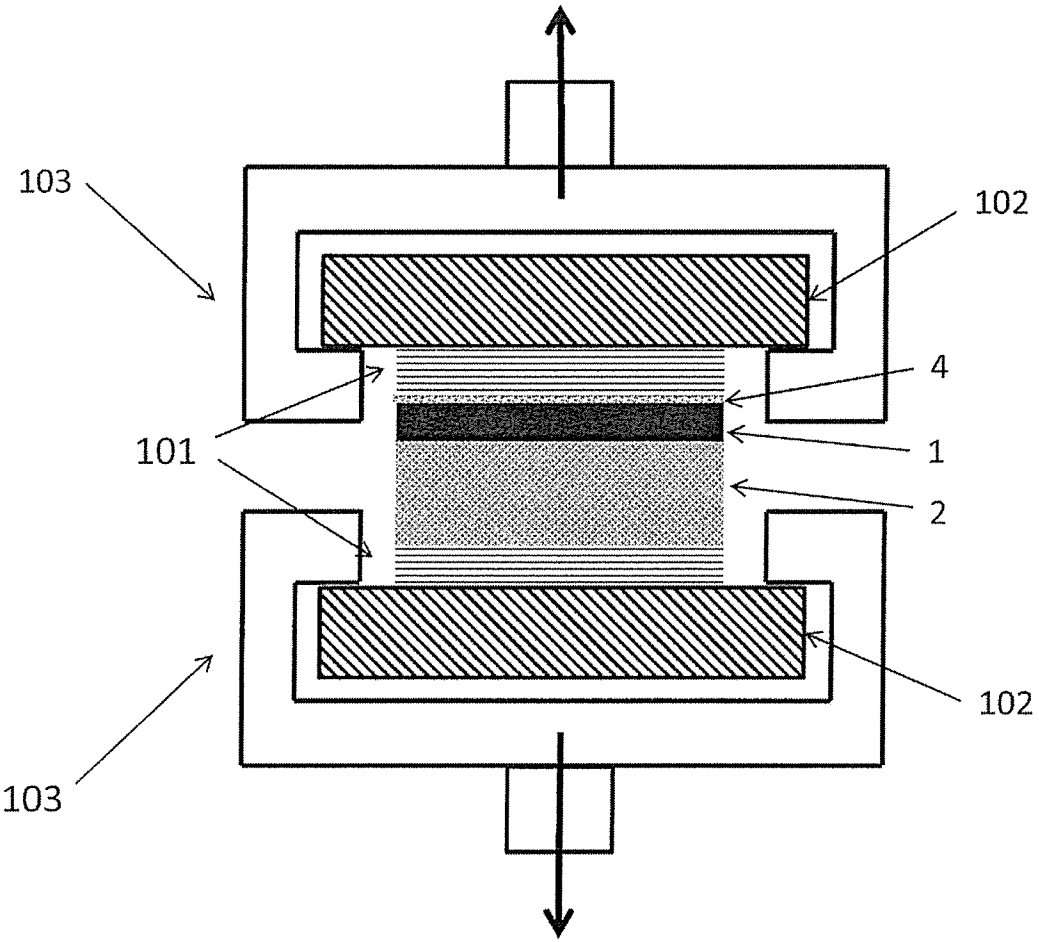
FIG. 5 is a schematic view of the bonding strength measurement between a metallic substrate and a core material (synthetic resin foam) in examples.

The bonding strength between the metallic substrate and the core material was measured as illustrated in FIG. 5. First, the front and back surfaces of the metal siding material measuring 50 mm×50 mm from which the back-side material was removed were bonded to wooden pieces 102 (9 mm×65 mm×70 mm) with a hotmelt adhesive 101 (product name: Hotmelt Stick Multiple Uses White HSW-01K, produced by Henkel Japan Ltd.). With a tension jig 103, the metal siding material with wooden pieces was pulled towards the directions of the arrows at a tension rate of 5 mm/min to measure the maximum strength at detachment (kg/$cm^2$). The maximum strengths at detachment measured at three positions, a fitting member on the male side of the siding, a central part and a fitting part on the female side were averaged to obtain the bonding strength between the metallic substrate and the synthetic resin foam. The bonding strength at or above 0.3 g/$cm^2$ was regarded as acceptable.

The siding material was subjected to flame treatment with the above burner and printing was performed under the above printing conditions. The sample was measured for the dot diameter of black ink and the bonding strength between the metallic substrate and the core material. The test results are shown below.

TABLE 2

| | Burner output (kJ/h/10 mm) | Length of flame port along the travelling direction (mm) | Transportation velocity (m/min) | Distance between burner head and siding material | Maximum height of recesses and projections of pattern (mm) | Surface temperature of metallic substrate (° C.) | Dot diameter of black ink at embossed part (μm) Radically polymerizable ultraviolet curable ink: Projected part | Recessed part parallel to the transportation direction | Recessed part perpendicular to the transportation direction | Evaluation |
|---|---|---|---|---|---|---|---|---|---|---|
| Example 1 | 250 | 5 | 5 | 10 | 0.5 | 229 | 196 | 197 | 191 | ○ |
| Example 2 | 1500 | 20 | 15 | 30 | 0.5 | 122 | 202 | 200 | 196 | ○ |
| Example 3 | 2500 | 20 | 20 | 50 | 0.5 | 85 | 205 | 206 | 204 | ○ |
| Example 4 | 2500 | 20 | 20 | 50 | 1.0 | 89 | 203 | 193 | 191 | ○ |
| Example 5 | 2500 | 30 | 20 | 50 | 1.0 | 78 | 199 | 197 | 192 | ○ |
| Example 6 | 5000 | 20 | 20 | 50 | 0.5 | 135 | 207 | 205 | 199 | ○ |
| Example 7 | 5000 | 20 | 20 | 50 | 1.0 | 141 | 202 | 197 | 192 | ○ |
| Example 8 | 5000 | 30 | 20 | 50 | 1.0 | 129 | 205 | 200 | 197 | ○ |
| Example 9 | 7500 | 20 | 20 | 50 | 0.5 | 256 | 210 | 208 | 208 | ○ |
| Example 10 | 7500 | 20 | 20 | 50 | 1.5 | 261 | 209 | 204 | 201 | ○ |
| Example 11 | 12000 | 20 | 5 | 120 | 0.5 | 298 | 198 | 199 | 191 | ○ |
| Example 12 | 12000 | 20 | 20 | 50 | 1.5 | 294 | 208 | 209 | 207 | ○ |
| Example 13 | 12000 | 40 | 70 | 20 | 0.5 | 159 | 197 | 199 | 193 | ○ |
| Comparative Example 1 | 13000 | 20 | 20 | 50 | 1.5 | 319 | 209 | 210 | 208 | ○ |
| Comparative Example 2 | 220 | 5 | 5 | 10 | 0.5 | 211 | 195 | 191 | 180 | X |
| Comparetive Example 3 | 250 | 5 | 3 | 10 | 0.5 | 302 | 198 | 199 | 192 | ○ |

TABLE 2-continued

| | Dot diameter of black ink at embossed part (μm) Cationically polymerizable ultraviolet curable ink | | | | Bonding strength between metallic substrate and core material | |
|---|---|---|---|---|---|---|
| | Projected part | Recessed part parallel to the transportation direction | Recessed part perpendicular to the transportation direction | Evaluation | Bonding strength (kg/cm$^2$) | Evaluation |
| Example 1 | 200 | 202 | 200 | ○ | 0.43 | ○ |
| Example 2 | 208 | 206 | 200 | ○ | 0.57 | ○ |
| Example 3 | 210 | 209 | 202 | ○ | 0.61 | ○ |
| Example 4 | 212 | 214 | 200 | ○ | 0.64 | ○ |
| Example 5 | 211 | 210 | 211 | ○ | 0.61 | ○ |
| Example 6 | 215 | 212 | 210 | ○ | 0.54 | ○ |
| Example 7 | 217 | 213 | 201 | ○ | 0.57 | ○ |
| Example 8 | 215 | 212 | 204 | ○ | 0.53 | ○ |
| Example 9 | 218 | 216 | 214 | ○ | 0.31 | ○ |
| Example 10 | 215 | 216 | 209 | ○ | 0.33 | ○ |
| Example 11 | 204 | 203 | 201 | ○ | 0.31 | ○ |
| Example 12 | 218 | 217 | 213 | ○ | 0.32 | ○ |
| Example 13 | 204 | 206 | 202 | ○ | 0.50 | ○ |
| Comparative Example 1 | 219 | 218 | 214 | ○ | 0.24 | X |
| Comparative Example 2 | 208 | 198 | 179 | X | 0.36 | ○ |
| Comparetive Example 3 | 203 | 202 | 201 | ○ | 0.29 | X |

Acceptable range: 190 to 210 μm
Acceptable range: 200 to 220 μm
Acceptable range: 0.3 kg/cm$^2$ or higher The burner output represents the output relative to the 10-mm width of the flame port. Therefore, even when the length of the flame port along the travelling direction varies, the energy of flame irradiated from the burner is identical. For example, Examples 7 and 8 are the same in the burner output and different in the length of the flame port along the travelling direction. However, Examples 7 and 8 are the same in the energy which the metallic substrate of the metal siding material receives from the flame discharged from the burner.

REFERENCE SIGNS LIST

1 Metal siding material
11 Metallic substrate
12 Core material
13 Back-surface material
14 Ink receiving layer
2 Burner
21 Flame port
22 Burner head
3 Flame
d The height difference between recesses and projections on the metallic substrate
H The shortest distance between the burner 2 and the printing surface 1-1
4 Transporting machine
1-1 Transporting surface
5 Inkjet coating machine
61 Inkjet recording head (yellow)
62 Inkjet recording head (cyan)
63 Inkjet recording head (magenta)
64 Inkjet recording head (black)
71 Ink supply tank (yellow)
72 Ink supply tank (cyan)
73 Ink supply tank (magenta)
74 Ink supply tank (black)
8 Control unit
9 Active ray irradiation machine
1-1 Printing surface
M Line inkjet recording device
101 Hotmelt adhesive
102 Wooden piece
103 Tension jig

The invention claimed is:

1. A method for manufacturing a decorative construction plate, the method comprising subjecting a metal siding material including: a metallic substrate on which a recess-projection pattern having a height difference of 0.5 mm or more is formed and on which an ink receiving layer formed from a resin composition is provided; a core material; and a back-side material, to flame treatment by exposing the metal siding material to flame with an output of 250 kJ/h to 12000 kJ/h per 10-mm width of a flame port of a burner so that the surface temperature of the substrate does not exceed 300° C., followed by performing inkjet printing using an active ray curable ink.

2. The method for manufacturing a decorative construction plate of claim 1, wherein the active ray curable ink is impermeable through the ink receiving layer.

3. The method for manufacturing a decorative construction plate of claim 1, wherein the active ray curable ink is an active ray curable cationically polymerizable ink.

4. The method for manufacturing a decorative construction plate of claim 1, wherein the height difference of the recess-projection pattern is 7.0 mm or less.

5. The method for manufacturing a decorative construction plate of claim 1, wherein the metal siding material is transported at a velocity of 5.0 m/min to 70 m/min.

6. The method for manufacturing a decorative construction plate of claim 1, wherein the core material is a polyisocyanurate foam.

* * * * *